US007637186B1

(12) United States Patent
Loscalzo

(10) Patent No.: US 7,637,186 B1
(45) Date of Patent: Dec. 29, 2009

(54) PNEUMATIC PIPE WRENCH AND ASSOCIATED METHOD

(76) Inventor: Raymond Loscalzo, 19 Tall Oak Dr., Huntington, NY (US) 11743

( * ) Notice: Subject to any disclaimer, the term of this patent is extended or adjusted under 35 U.S.C. 154(b) by 0 days.

(21) Appl. No.: 11/894,488

(22) Filed: Aug. 21, 2007

Related U.S. Application Data

(60) Provisional application No. 60/822,831, filed on Aug. 18, 2006.

(51) Int. Cl.
*B25B 23/08* (2006.01)
*B25B 23/10* (2006.01)

(52) U.S. Cl. ..... 81/449; 81/442; 81/448

(58) Field of Classification Search ..... 81/442–449
See application file for complete search history.

(56) References Cited

U.S. PATENT DOCUMENTS 1,354,538 A * 10/1920 Devereaux ..... 81/448
1,518,087 A * 12/1924 McMullen ..... 81/448
1,672,053 A 6/1928 Brown
1,908,622 A * 5/1933 Baker et al. ..... 294/86.25
2,018,154 A * 10/1935 Scott ..... 81/437
2,468,867 A 5/1949 Collins
2,624,609 A * 1/1953 Storm ..... 294/86.4
3,296,900 A * 1/1967 Behnke ..... 81/448
5,224,401 A * 7/1993 Cesari et al. ..... 81/442

* cited by examiner

*Primary Examiner*—Bryan R Muller

(57) ABSTRACT

A pneumatic pipe wrench includes an elongated shaft provided with axially opposed top and bottom ends respectively and a cylindrical shaft guide removably connected to the shaft. The apparatus further includes a mechanism for attaching the shaft guide to the shaft, a mechanism for removably securing the bottom end of the shaft to an inner surface of the existing length of pipe, and a mechanism for loosening the existing length of pipe. Such a loosening mechanism is removably connected to the shaft. The loosening mechanism includes the handle of the pumping mechanism and the depressions of the shaft.

12 Claims, 8 Drawing Sheets

PNEUMATIC PIPE WRENCH AND ASSOCIATED METHOD

CROSS REFERENCE TO RELATED APPLICATIONS

This application claims the benefit of U.S. Provisional Application No. 60/822,831, filed Aug. 18, 2006, the entire disclosure of which is incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to pipe wrenches and, more particularly, to a pneumatic pipe wrench and associated method for assisting a user to remove an existing length of pipe from below a ground surface while the user remains above the ground surface.

2. Prior Art

There are many common items that most individuals take for granted which are much more important than their external appearance would lead one to believe. One such item is a pipe; a pipe that forms a part of a piping system that is used to provide any number of services, utilities, and functions that are vital in so many different areas. Although pipes and piping systems are used in many different applications, one area that most are familiar with is the utilities that are used by virtually all residential, commercial, industrial, and other types of structures.

Pipes and piping systems are an integral part of utility systems and are used in virtually every type of structure. Such piping systems are used in many other essential applications like conveying oil and petroleum distillates during the various stages of refining and into storage tanks. Piping systems are generally comprised of supply pipelines positioned either on the surface or underground, like the piping systems that are installed in individual structures.

Generally, but not always, pipes that are installed in structures are much easier to access for repair and/or replacement pipes that are installed underground, especially if they are installed beneath a concrete surface. Whenever these types of pipes have to be repaired or replaced, a great deal of work may be entailed to break up and remove soil or concrete just to access the pipe. There are also many situations where pipes installed in structures are located in extremely tight places and, if they must be removed, it is very difficult just to fit a pipe wrench around it.

U.S. Pat. No. 5,224,401 to Cesari discloses a vicing tool for internally gripping hollow bodies, in particular, those of a tubular nature. The tool is comprised of a body created in two halves having two mating faces that are angularly displaceable with respect to one another. From at least one side of the body, a nose extends that is formed by two elongated members with substantially semicylindrical lateral surfaces. The nose is composed of longitudinal concentric portions of increasing diameter starting from its free end, and the rotational axis is parallel and eccentric with respect to the longitudinal axis of said nose. Unfortunately, this prior art example is not designed for extracting an underground damaged pipe.

U.S. Pat. No. 6,938,525 to Poole discloses a pipe wrench having a uniquely handy control lever and one-way ratchet for very rapid adjustment of wrench position. The wrench also has a pivoting upper jaw that further aids a user in adjusting and tightening the wrench while using only one hand. The wrench may also be used as a hand tool for clamping an object. Unfortunately, this prior art example is not designed for extracting an underground damaged pipe.

U.S. Pat. No. 5,349,887 to Suwa discloses a tubular pipe wrench for removing and replacing pipes in inaccessible locations. The wrench includes a generally cylindrical head member having an internal passage large enough to pass the pipe to be worked on and having a cross-sectional configuration like a triangle with greatly rounded corners. A jaw member having teeth is loosely fastened in each of the three corners by bolts which pass through slots in the sidewalls of the head member. Concentric with the head member is a sleeve having ports for receiving the bolts and which maintains the relative spacing of the bolts even though they move radially in the slots. When a pipe is inside of the head member, a slight turning of the head member and sleeve in either direction causes the teeth of the jaw members to make contact with the pipe, moving the jaws into a position where they are wedged between the pipe and the flattened cam surfaces on the inside of the head. Further turning of the sleeve and head will turn the pipe. An extension member which is also cylindrical has a castellated interconnection with the head member. A drive member has a similar castellated interconnection with the extension member and flattened surfaces to be turned with a conventional wrench. Unfortunately, this prior art example is not designed for use without digging up the surrounding ground area.

Accordingly, the present invention is disclosed in order to overcome the above noted shortcomings. The present invention satisfies such a need by providing an apparatus that is convenient and easy to use, lightweight yet durable in design, and designed for assisting a user to remove an existing length of pipe from below a ground surface while the user remains above the ground surface. The pneumatic pipe wrench removes a damaged below ground pipe without digging up surrounding ground, thereby saving in labor and materials needed. The present invention is simple to use, inexpensive, and designed for many years of repeated use.

BRIEF SUMMARY OF THE INVENTION

In view of the foregoing background, it is therefore an object of the present invention to provide a mechanism for assisting a user to remove an existing length of pipe from below a ground surface while the user remains above the ground surface. These and other objects, features, and advantages of the invention are provided by a pneumatic pipe wrench.

A pneumatic pipe wrench includes an elongated shaft provided with axially opposed top and bottom ends respectively. Such a shaft effectively has a hollow interior extending along an entire longitudinal length thereof. The shaft has a uniform diameter extending along the longitudinal length thereof and also has a plurality of circular depressions monolithically formed in an outer surface thereof. Such depressions are diametrically opposed about the shaft and further are equidistantly spaced along the longitudinal length of the shaft. Each of the depressions terminate proximal to an inner surface of the shaft.

The apparatus further includes a cylindrical shaft guide removably connected to the shaft. Such a shaft guide includes an upper section with a pair of threaded apertures formed therein. Such apertures are conveniently located on diametrically opposed sides of the upper section of the shaft guide, and each of the apertures has a centrally registered axis oriented perpendicular to a longitudinal length of the shaft guide. Each of the apertures has a diameter that is equal to a diameter of each of the depressions of the shaft. The shaft guide further includes a lower section monolithically formed with the upper section and extending downwardly therefrom. Such a lower section has a longitudinal length equal to the upper section, and the lower section further has a diameter that is equal to a diameter of the upper section. The lower section of the shaft guide is advantageously interfitted over a top end of the existing length of pipe during operating conditions, and the respective diameters of the upper and lower sections are greater than a diameter of the shaft such that the shaft is telescopically interfitted within the shaft guide. The shaft guide is telescopically adjusted along the entire longitudinal length of the shaft.

The apparatus further includes a mechanism for attaching the shaft guide to the shaft. Such an attaching mechanism includes a pair of threaded rods with axially opposed proximal and distal ends respectively. Such a distal end of the rod removably penetrates an associated one of the apertures of the shaft guide. Each of the rods has a knob directly attached to the proximal end thereof such that the knob is spaced from the distal end of the rod. The rod effectively rotates in sync with the knob and the distal end of the rod directly abuts an associated one of the depressions of the shaft when the rod is penetrated through an associated one of the apertures of the shaft guide. The rods and the shaft guide and the depressions of the shaft respectively cooperate to prohibit the shaft guide from prematurely and undesirably shifting along the longitudinal length of the shaft during operating conditions.

The apparatus further includes a mechanism for removably securing the bottom end of the shaft to an inner surface of the existing length of pipe. Such a removable securing mechanism is directly attached to the top and bottom ends of the shaft respectively. The removable securing mechanism conveniently includes a mechanism for pumping a quantity of air into the shaft. Such a pumping mechanism includes a support plate integrally attached to the top end of the shaft and provided with opposed first and second ends respectively. Such a support plate has a top surface oriented at a right angle to the longitudinal length of the shaft.

A pair of coextensively shaped anchor tabs is monolithically formed with the top surface of the support plate. Such tabs advantageously extend upwardly and away from the top surface of the support plate, and are located along laterally opposed edges of the support plate and further are located at the first end of the support plate. Each of the tabs has an inner surface oriented parallel to a longitudinal length of the support plate and an arm provided with a distal end pivotally attached to each of the respective inner surfaces of the tabs. Such an arm has a proximal end biased upwardly and away from the top surface of the support plate. The arm is biased 180 degrees along an arcuate path defined by the pivot point, and the proximal end of the arm has a cavity formed therein. A substantially T-shaped handle has axially opposed proximal and distal ends respectively. Such a distal end of the handle effectively has a diameter that is less than a diameter of the cavity of the proximal end of the arm such that the distal end of the handle is removably interfitted with the cavity of the arm during operating procedures.

The proximal end of the handle has a longitudinal length oriented perpendicular to the longitudinal length of the distal end of the handle. The handle is conveniently manipulated by the user such that a quantity of air is introduced into the shaft during operating conditions thereby increasing a pressure of air contained within the shaft above a pressure of the ambient air outside of the shaft. A pressure-release valve is formed within the outer surface of the shaft and located subjacent to the top end of the shaft. Such a valve is for releasing an air pressure contained within the shaft.

The removable securing mechanism further includes a mechanism for removably adhering the bottom end of the shaft to an inner surface of the existing length of pipe. Such a removable adhering mechanism includes a first toothed surface monolithically formed in a portion of the outer surface of the bottom end of the shaft and a curvilinear arm with a first end pivotally connected to the outer surface of the bottom end of the shaft. Such an arm is advantageously located on a diametrically opposed side from the first toothed surface and has a second toothed surface formed in an outer surface thereof. The arm is biased outwardly and away from the shaft along a first arcuate path such that the second toothed surface abuts directly against the inner surface of the existing length of pipe and is statically adhered thereto during operating conditions.

The removable adhering mechanism further includes a housing integrally attached to the inner surface of the bottom end of the shaft. Such a housing is in fluid communication with the pumping mechanism such that a quantity of air introduced into the shaft via the pumping mechanism is channeled through the housing. A linear piston effectively has a first end telescopically interfitted within the housing. Such a piston has a second end extending outwardly and away from the first end of the piston, and such a second end of the piston contacts an inner surface of the arm. An air pressure conveniently introduced into the housing via the shaft and the pumping mechanism respectively shifts the piston along a first linear path such that the piston causes the arm to bias away from the shaft along the first arcuate path and further causes the second toothed surface of the arm to statically abut against the inner surface of the existing length of pipe.

The removable adhering mechanism further includes a spring member with a first end statically affixed to the inner surface of the shaft. Such a spring member has a second end pivotally attached to a second end of the arm, and a linear pin is statically attached to a center region of the bottom end of the shaft and extends downwardly and away therefrom. Such a pin has a longitudinal length registered parallel with the longitudinal length of the shaft. The pin is for advantageously spacing the bottom end of the shaft from an inner surface of another existing length of pipe connected at a right angle to the existing length of pipe. The spring member returns the arm to an equilibrium position along a second arcuate path defined opposite of the first arcuate path when the pressure release valve is manipulated thereby reducing the air pressure within the shaft and the housing respectively. The reduced air pressure allows the spring member to return the arm to equilibrium and simultaneously causes the piston to return to equilibrium along a second linear path defined opposite of the first linear path.

The wrench further includes a mechanism for effectively loosening the existing length of pipe. Such a loosening mechanism is removably connected to the shaft. The loosening mechanism includes the handle of the pumping mechanism and the depressions of the shaft. The distal end of the handle is advantageously interfitted within an associated one of the depressions of the shaft such that a force applied to the handle along the horizontal plane imparts a rotating force to the inner surface of the existing length of pipe via the bottom end of the shaft thereby loosening the existing length of pipe.

A method for assisting a user to remove an existing length of pipe from below a ground surface while the user remains above the ground surface includes the steps of providing an elongated shaft with axially opposed top and bottom ends respectively. Such a shaft has a hollow interior extending along an entire longitudinal length thereof. The shaft has a uniform diameter extending along the longitudinal length thereof. The steps further include: connecting a cylindrical shaft guide to the shaft; attaching the shaft guide to the shaft; and securing the bottom end of the shaft to an inner surface of the existing length of pipe. The removable securing mechanism is directly attached to the top and bottom ends of the shaft respectively. The steps further include loosening the existing length of pipe. The loosening mechanism is removably connected to the shaft.

The method further includes the steps of providing an upper section with a pair of threaded apertures formed therein. Such apertures are located on diametrically opposed sides of the upper section of the shaft guide, and each of the apertures has a centrally registered axis oriented perpendicular to a longitudinal length of the shaft guide. Each of the apertures has a diameter that is equal to a diameter of each of the depressions of the shaft. The steps further include providing a lower section monolithically formed with the upper section and extending downwardly therefrom. Such a lower section has a longitudinal length equal to the upper section, and the lower section further has a diameter that is equal to a diameter of the upper section. The steps further include interfitting the lower section of the shaft guide over a top end of the existing length of pipe during operating conditions wherein the respective diameters of the upper and lower sections are greater than a diameter of the shaft such that the shaft is telescopically interfitted within the shaft guide. The steps further include adjusting the shaft guide telescopically along the entire longitudinal length of the shaft.

The method of further includes the steps of penetrating a pair of threaded rods with axially opposed proximal and distal ends respectively through an associated one of the apertures of the shaft guide. Each of such rods has a knob directly attached to the proximal end thereof such that the knob is spaced from the distal end of the rod. The rod rotates in sync with the knob. The steps further include abutting the distal end of the rod directly against an associated one of the depressions of the shaft when the rod is penetrated through an associated one of the apertures of the shaft guide. The rod and the shaft guide and the depressions of the shaft respectively cooperate to prohibit the shaft guide from prematurely and undesirably shifting along the longitudinal length of the shaft during operating conditions.

The method further includes the steps of providing a mechanism for pumping a quantity of air into the shaft. Such a pumping mechanism includes providing a support plate integrally attached to the top end of the shaft and provided with opposed first and second ends respectively. Such a support plate has a top surface oriented at a right angle to the longitudinal length of the shaft. The pumping mechanism further includes a pair of coextensively shaped anchor tabs monolithically formed with the top surface of the support plate. Such tabs extend upwardly and away from the top surface of the support plate, and the tabs are located along laterally opposed edges of the support plate and further are located at the first end of the support plate. Each of the tabs has an inner surface oriented parallel to a longitudinal length of the support plate. The pumping mechanism further includes the step of attaching a distal end of an arm pivotally to each of the respective inner surfaces of the tabs.

The steps further include biasing a proximal end of the arm upwardly and away from the top surface of the support plate. The arm is biased 180 degrees along an arcuate path defined by the pivot point, and the proximal end of the arm has a cavity formed therein. The steps further include interfitting a distal end of a substantially T-shaped handle with axially opposed proximal and distal ends respectively within the cavity of the arm. Such a distal end of the handle has a diameter that is less than a diameter of the cavity of the arm, and such a proximal end of the handle has a longitudinal length oriented perpendicular to the longitudinal length of the distal end of the handle. The steps further include manipulating the handle such that a quantity of air is introduced into the shaft during operating conditions thereby increasing a pressure of air contained within the shaft above a pressure of the ambient air outside of the shaft and providing a pressure-release valve formed within the outer surface of the shaft and located subjacent to the top end of the shaft. Such a valve is for releasing an air pressure contained within the shaft.

The steps further include providing a mechanism for removably adhering the bottom end of the shaft to an inner surface of the existing length of pipe. Such a removable adhering mechanism includes providing a first toothed surface monolithically formed in a portion of the outer surface of the bottom end of the shaft, and connecting a curvilinear arm with a first end pivotally to the outer surface of the bottom end of the shaft. Such an arm is located on a diametrically opposed side from the first toothed surface, and has a second toothed surface formed in an outer surface thereof. The steps further include biasing the arm outwardly and away from the shaft along a first arcuate path such that the second toothed surface abuts directly against the inner surface of the existing length of pipe and is statically adhered thereto during operating conditions and providing a housing integrally attached to the inner surface of the bottom end of the shaft. Such a housing is in fluid communication with the pumping mechanism such that a quantity of air introduced into the shaft via the pumping mechanism is channeled through the housing.

The steps further include providing a linear piston with a first end telescopically interfitted within the housing. Such a piston has a second end extending outwardly and away from the first end of the piston, and the second end of the piston contacts an inner surface of the arm. The steps further include introducing an air pressure into the housing via the shaft and the pumping mechanism respectively such that the air pressure shifts the piston along a first linear path such that the piston causes the arm to bias away from the shaft along the first arcuate path and further causes the second toothed surface of the arm to statically abut against the inner surface of the existing length of pipe. The steps further include providing a spring member with a first end statically affixed to the inner surface of the shaft. Such a spring member has a second end pivotally attached to a second end of the arm. The spring member returns the arm to an equilibrium position along a second arcuate path defined opposite of the first arcuate path when the pressure release valve is manipulated thereby reducing the air pressure within the shaft and the housing respectively. The reduced air pressure allows the spring member to return the arm to equilibrium and simultaneously causes the piston to return to equilibrium along a second linear path defined opposite of the first linear path.

The steps further include providing a linear pin statically attached to a center region of the bottom end of the shaft and extending downwardly and away therefrom. Such a pin has a longitudinal length registered parallel with the longitudinal length of the shaft. The pin is for spacing the bottom end of the shaft from an inner surface of another existing length of pipe connected at a right angle to the existing length of pipe.

The method further includes the steps of: providing the handle of the pumping mechanism; providing the depressions of the shaft; interfitting the distal end of the handle is within an associated one of the depressions; applying a force to the handle along the horizontal plane thereby imparting a rotating force to the inner surface of the existing length of pipe via the bottom end of the shaft; loosening the existing length of pipe; removing the existing length of pipe from below the ground surface; manipulating the valve and returning the air pressure within the shaft to equilibrium; and removing the shaft from the existing length of pipe.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
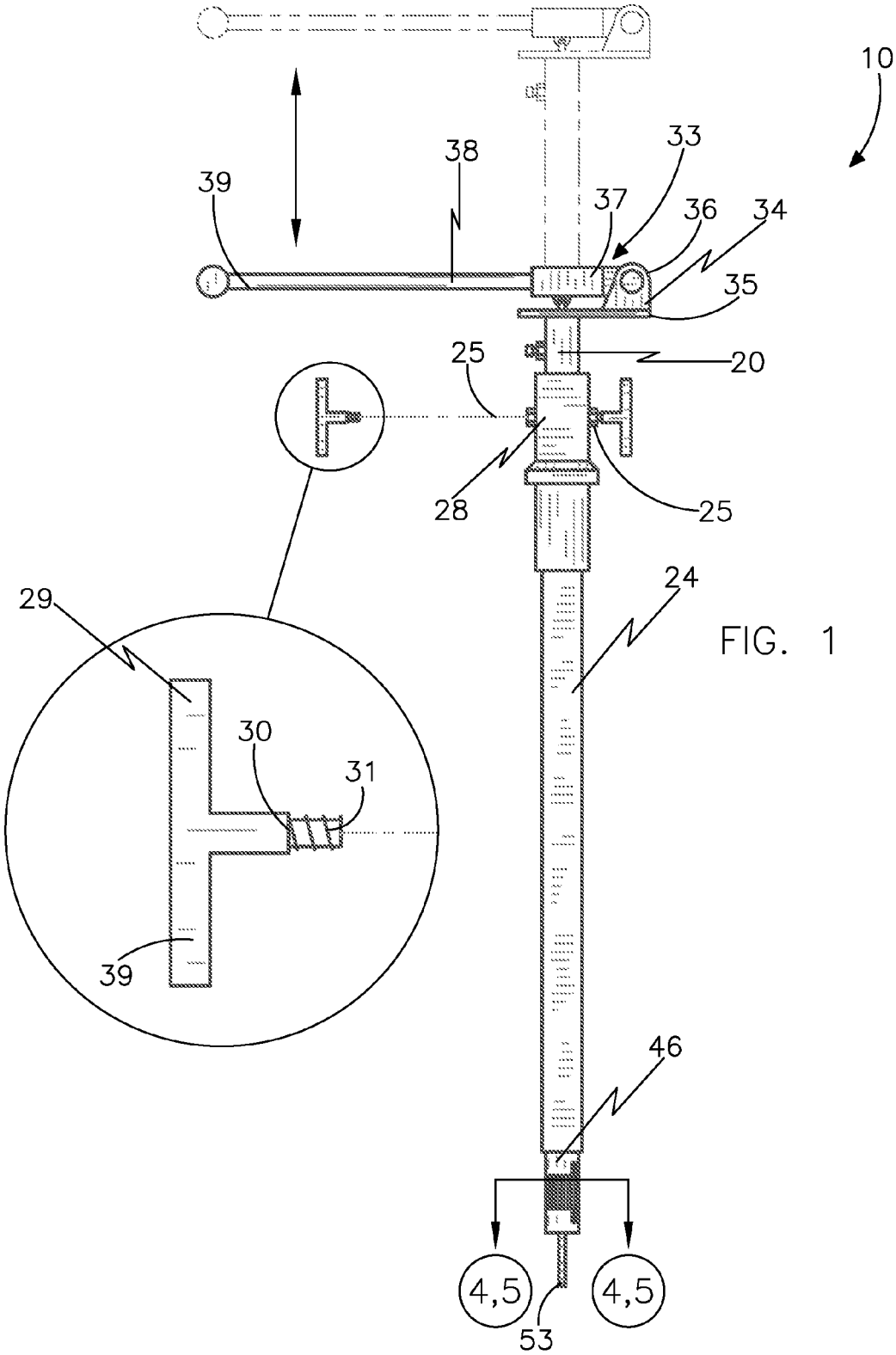
FIG. 1 is side elevational view of a pneumatic pipe wrench, with an enlarged view of the rod, in accordance with the present invention.
Figure 2:
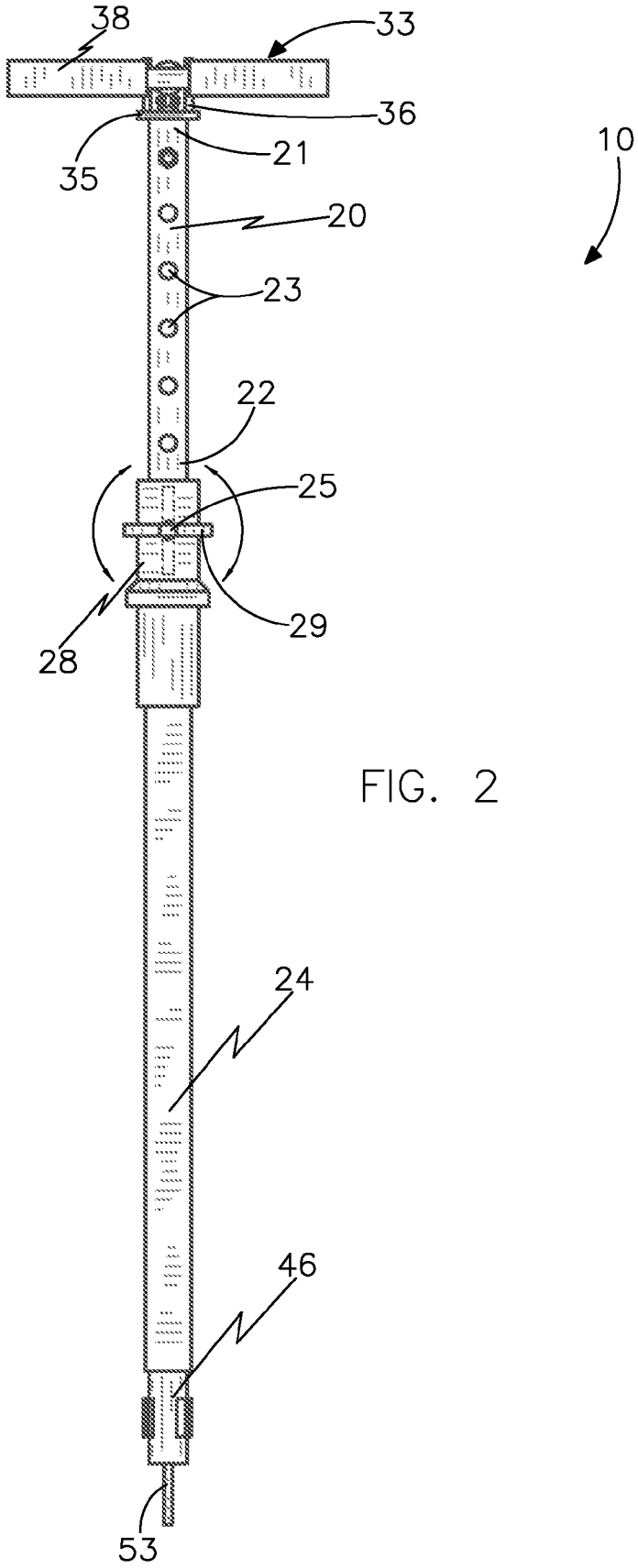
FIG. 2 is a rear elevational view of a pneumatic pipe wrench, in accordance with the present invention.
Figure 3:
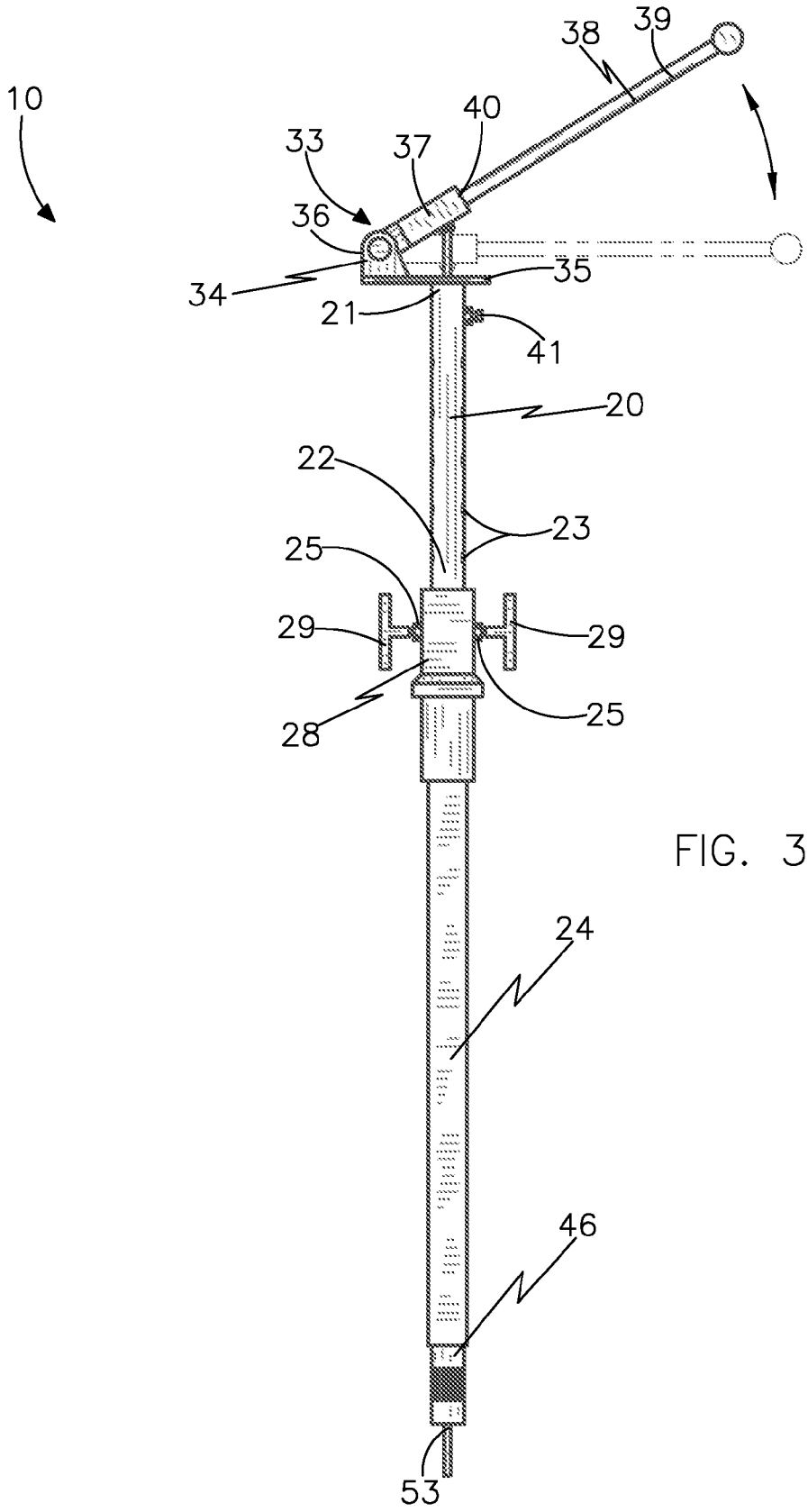
FIG. 3 is an alternate side elevational view of a pneumatic pipe wrench, showing the pumping motion of the removable securing mechanism, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1-8 by the reference numeral 10 and is intended to provide a mechanism for assisting a user to remove an existing length of pipe from below a ground surface while the user remains above the ground surface. It should be understood that the apparatus 10 may be used with many different types of pipes and should not be limited in use with only those types of pipes mentioned herein.

Referring to FIGS. 1, 2, 3, 6 and 7, a pneumatic pipe wrench includes an elongated shaft provided 20 with axially opposed top and bottom ends 21, 22 respectively. Such a shaft 20 has a hollow interior extending along an entire longitudinal length thereof. The shaft 20 has a uniform diameter extending along the longitudinal length thereof and also has a plurality of circular depressions 23 monolithically formed in an outer surface thereof. Such depressions 23 are diametrically opposed about the shaft 20 and further are equidistantly spaced along the longitudinal length of the shaft 20. Each of the depressions 23 terminate proximal to an inner surface of the shaft 20. The depressions provide a mechanism for housing a handle and thereby supporting the shaft in a fixed position.

Referring again to FIGS. 1, 2, 3, 6 and 7, the apparatus further includes a cylindrical shaft guide 24 removably connected to the shaft 20. Such a shaft guide 24 includes an upper section with a pair of threaded apertures 25 formed therein. Such apertures 25 are located on diametrically opposed sides of the upper section of the shaft guide 24, and each of the apertures 25 has a centrally registered axis oriented perpendicular to a longitudinal length of the shaft guide 24. Each of the apertures 25 has a diameter that is equal to a diameter of each of the depressions of the shaft 20. The apertures provide a mechanism for removably connecting the shaft to the shaft guide.

The shaft guide 24 further includes a lower section 26 monolithically formed with the upper section 27 and extending downwardly therefrom. Such a lower section 26 has a longitudinal length equal to the upper section 27, and the lower section 26 further has a diameter that is equal to a diameter of the upper section 27. The lower section 26 of the shaft guide 24 is interfitted over a top end of the existing length of pipe during operating conditions, and the respective diameters of the upper and lower sections are greater than a diameter of the shaft 20 which is essential such that the shaft 20 is telescopically interfitted within the shaft guide 24. The shaft guide 24 is telescopically adjusted along the entire longitudinal length of the shaft 20. The shaft guide provides a mechanism for housing the shaft and thereby guiding the shaft into a ground surface and pipe.

Referring primarily to FIG. 1, the apparatus further includes a mechanism for attaching the shaft guide to the shaft. Such an attaching mechanism 28 includes a pair of threaded rods 29 with axially opposed proximal and distal ends 30, 31 respectively. Such a distal end 31 of the rod 29 removably penetrates an associated one of the apertures 25 of the shaft guide 24. Each of the rods 29 has a knob 32 directly attached, without the use of intervening characters, to the proximal end 30 thereof which is critical such that the knob 32 is spaced from the distal end 31 of the rod. The rod 29 rotates in sync with the knob 32 and the distal end 31 of the rod 29 directly abuts, without the use of intervening characters, an associated one of the depressions 23 of the shaft 20 when the rod 29 is penetrated through an associated one of the apertures 25 of the shaft guide 24. The rods 29 and the shaft guide 24 and the depressions 23 of the shaft 20 respectively cooperate to prohibit the shaft guide 24 from prematurely and undesirably shifting along the longitudinal length of the shaft during operating conditions. The rods are tightened within the apertures and thereby prohibit the shaft from shifting within the shaft guide.

Referring to FIGS. 1, 2, 3, 6, 7 and 8, the apparatus further includes a mechanism for removably securing the bottom end of the shaft to an inner surface of the existing length of pipe. Such a removable securing mechanism 33 is directly attached, without the use of intervening characters, to the top and bottom ends of the shaft 20 respectively. The removable securing mechanism 33 includes a mechanism for pumping a quantity of air into the shaft. Such a pumping mechanism 34 includes a support plate 35 integrally attached to the top end of the shaft 20 and provided with opposed first and second ends respectively. Such a support plate 35 has a top surface oriented at a right angle to the longitudinal length of the shaft 20. The pumping mechanism provides a mechanism for pumping air into a piston and thereby tightening a bottom portion of the shaft while inside a broken pipe.

A pair of coextensively shaped anchor tabs 36 is monolithically formed with the top surface of the support plate 35. Such tabs 36 extend upwardly and away from the top surface of the support plate 35, and are located along laterally opposed edges of the support plate 35 and further are located at the first end of the support plate 35. Each of the tabs 36 has an inner surface oriented parallel to a longitudinal length of the support plate 35 and an arm 37 provided with a distal end pivotally attached to each of the respective inner surfaces of the tabs 36. Such an arm 37 has a proximal end biased upwardly and away from the top surface of the support plate 35. The arm 37 is biased 180 degrees along an arcuate path defined by the pivot point, and the proximal end of the arm 37 has a cavity formed therein. A substantially T-shaped handle 38 has axially opposed proximal and distal ends 39, 40 respectively. Such a distal end of the handle 38 has a diameter that is less than a diameter of the cavity of the proximal end of the arm 37 such that the distal end of the handle is removably interfitted with the cavity of the arm during operating procedures. The tabs provide a mechanism for allowing the arm to work pivotally on the support plate thereby allowing a pumping motion to be actuated by the handle.

The proximal 39 end of the handle 38 has a longitudinal length oriented perpendicular to the longitudinal length of the distal end 40 of the handle 38. The handle 38 is manipulated by the user which is crucial such that a quantity of air is introduced into the shaft 20 during operating conditions thereby increasing a pressure of air contained within the shaft above a pressure of the ambient air outside of the shaft 20. A pressure-release valve 41 is formed within the outer surface of the shaft 20 and located subjacent to the top end of the shaft. Such a valve 41 is for releasing an air pressure contained within the shaft 20. The pressure-release valve allows the air to be released from a piston, thereby making removal of the pipe wrench uninhibited.

Figure 4:
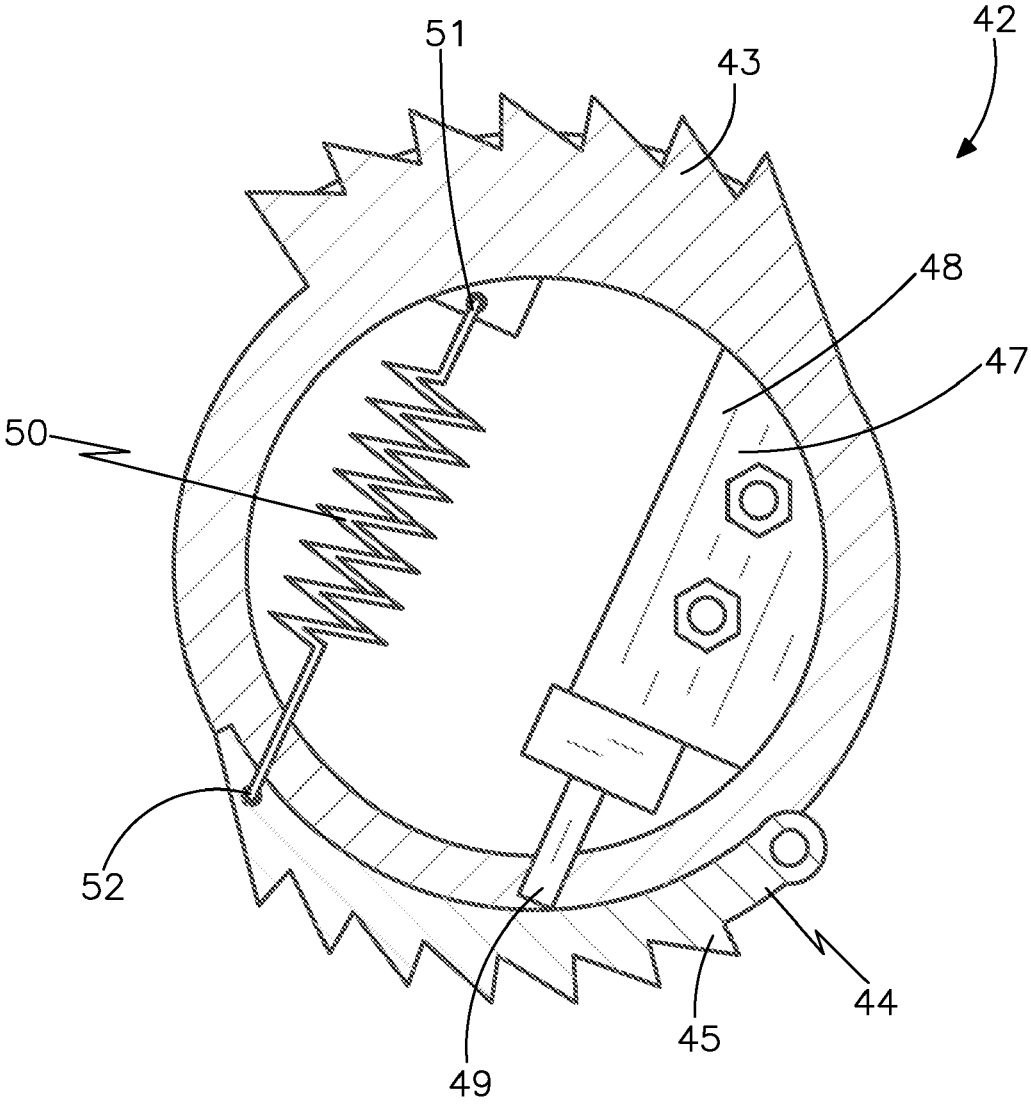
FIG. 4 is a cross sectional view of the removable adhering mechanism, with the arm in a closed position, taken along line 4-4, as shown in FIG. 1.
Figure 5:
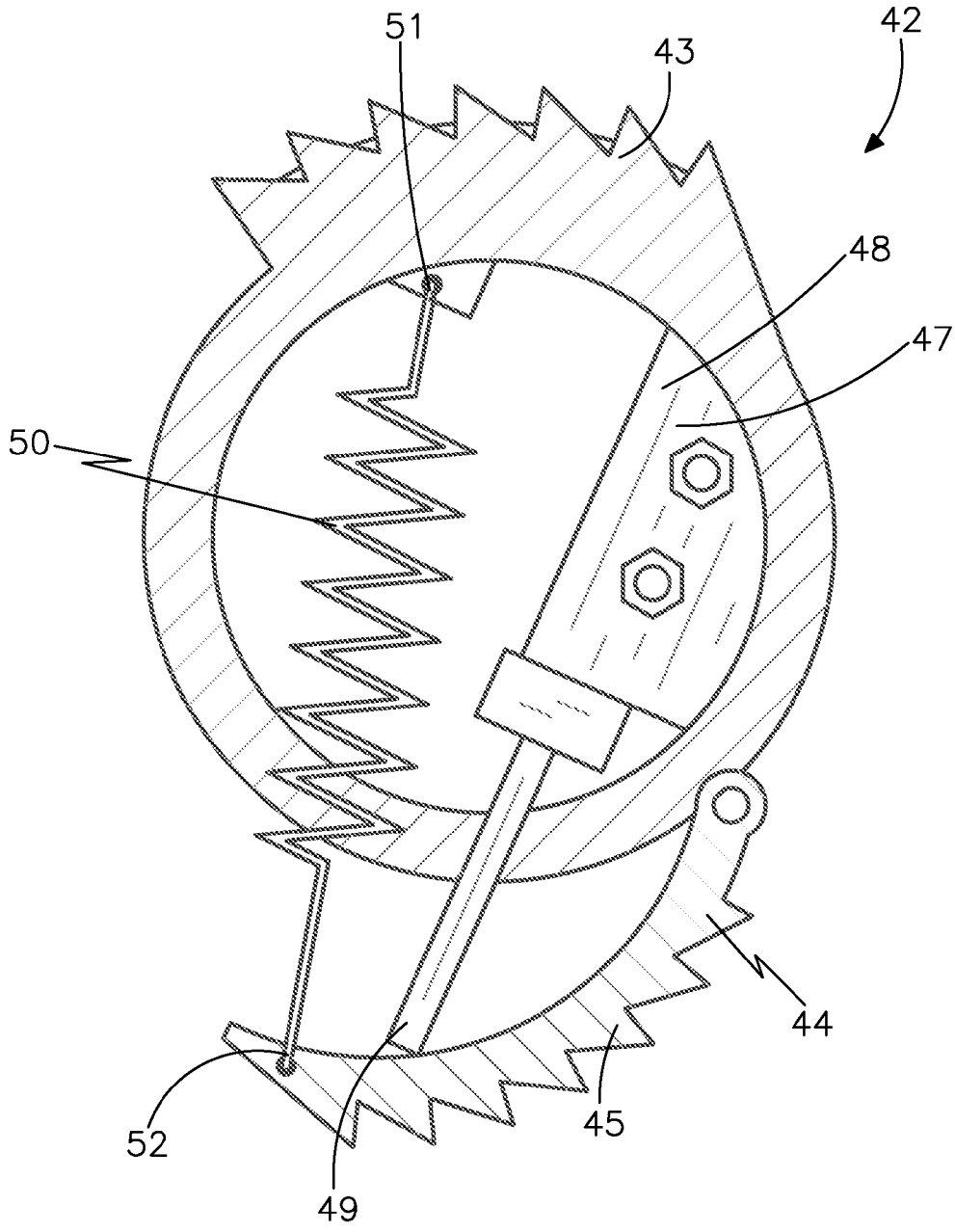
FIG. 5 is a cross sectional view of the removable adhering mechanism, with the arm in an open position, taken along line 5-5, as shown in FIG. 1.
Figure 6:
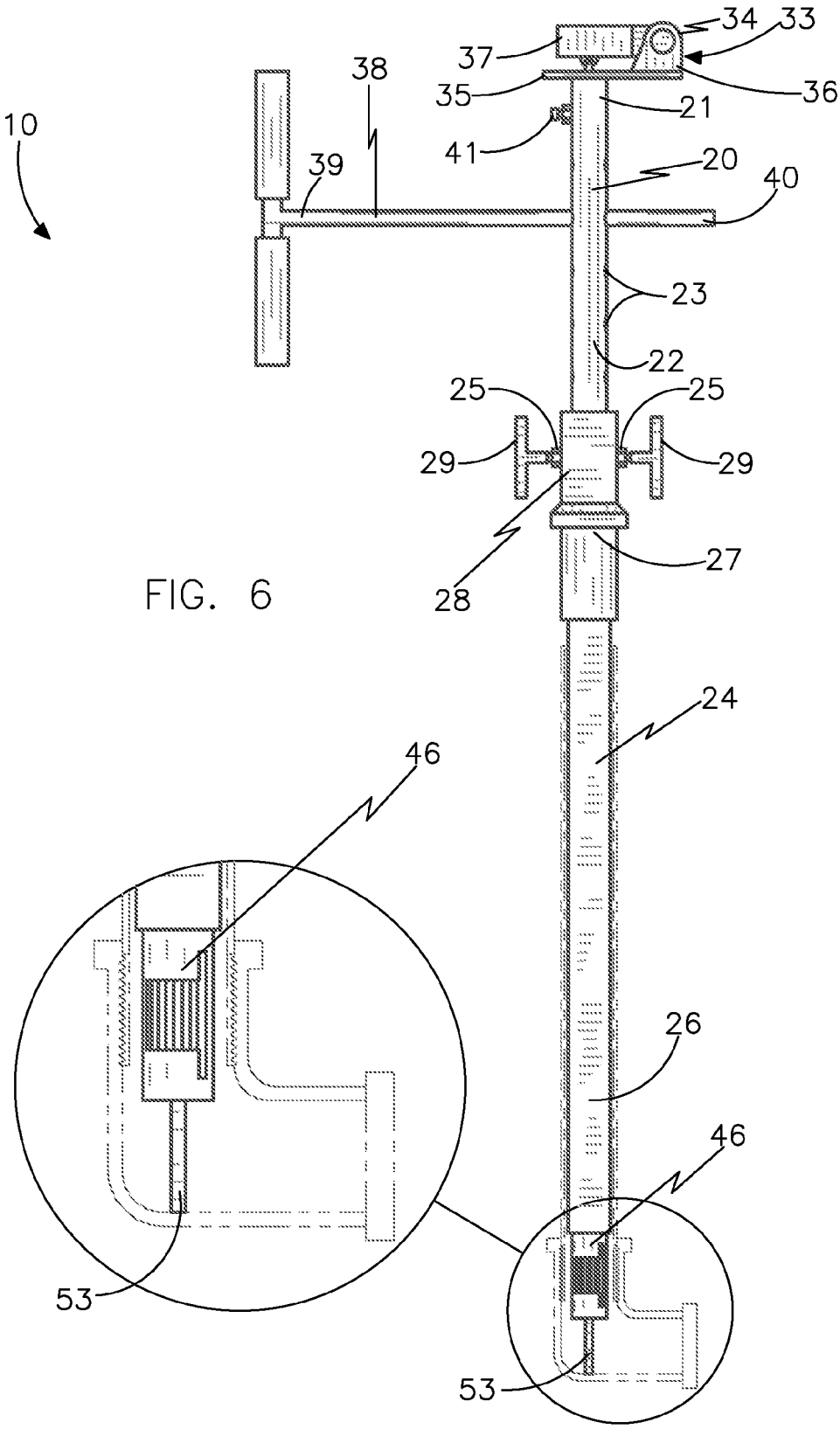
FIG. 6 is a side elevational view of a pneumatic pipe wrench, as shown in FIG. 1, in operation with a pipe, in accordance with the present invention.

Referring to FIGS. 4, 5 and 6, the removable securing mechanism further includes a mechanism for removably adhering the bottom end of the shaft to an inner surface of the existing length of pipe. Such a removable adhering mechanism 42 includes a first toothed 43 surface monolithically formed in a portion of the outer surface of the bottom end of the shaft 20 and a curvilinear arm 44 with a first end pivotally connected to the outer surface of the bottom end of the shaft 20. Such an arm 44 is located on a diametrically opposed side from the first toothed surface 43 and has a second toothed surface 45 formed in an outer surface thereof. The arm 44 is biased outwardly and away from the shaft 20 along a first arcuate path which is necessary such that the second toothed 45 surface abuts directly, without the use of intervening characters, against the inner surface of the existing length of pipe and is statically adhered thereto during operating conditions. The arm provides a mechanism for tightening the mechanism within a pipe, thereby grasping a pipe for easy removal.

The removable adhering mechanism further includes a housing 46 integrally attached to the inner surface of the bottom end of the shaft. Such a housing 46 is in fluid communication with the pumping mechanism which is important such that a quantity of air introduced into the shaft 20 via the pumping mechanism is channeled through the housing. A linear piston 47 has a first end 48 telescopically interfitted within the housing. Such a piston 47 has a second 49 end extending outwardly and away from the first end 48 of the piston 47, and such a second end of the piston 47 contacts an inner surface of the arm. An air pressure introduced into the housing 46 via the shaft 20 and the pumping mechanism respectively shifts the piston 47 along a first linear path which is essential such that the piston 47 causes the arm 44 to bias away from the shaft 20 along the first arcuate path and further causes the second toothed surface 45 of the arm 44 to statically abut against the inner surface of the existing length of pipe. The piston, working in communication with the pumping mechanism, provides a mechanism for extending the arm.

The removable adhering mechanism further includes a spring member 50 with a first end 51 statically affixed to the inner surface of the shaft. Such a spring member 50 has a second end 52 pivotally attached to a second end of the arm 44, and a linear pin 53 is statically attached to a center region of the bottom end of the shaft and extends downwardly and away therefrom. Such a pin has a longitudinal length registered parallel with the longitudinal length of the shaft. The pin 53 is for spacing the bottom end of the shaft 20 from an inner surface of another existing length of pipe connected at a right angle to the existing length of pipe. The spring member 50 returns the arm 44 to an equilibrium position along a second arcuate path defined opposite of the first arcuate path when the pressure release valve is manipulated thereby reducing the air pressure within the shaft and the housing respectively. The reduced air pressure allows the spring member to return the arm to equilibrium and simultaneously causes the piston to return to equilibrium along a second linear path defined opposite of the first linear path. The spring member ensures that the arm does not extend further than necessary during activation of the piston.

Figure 7:
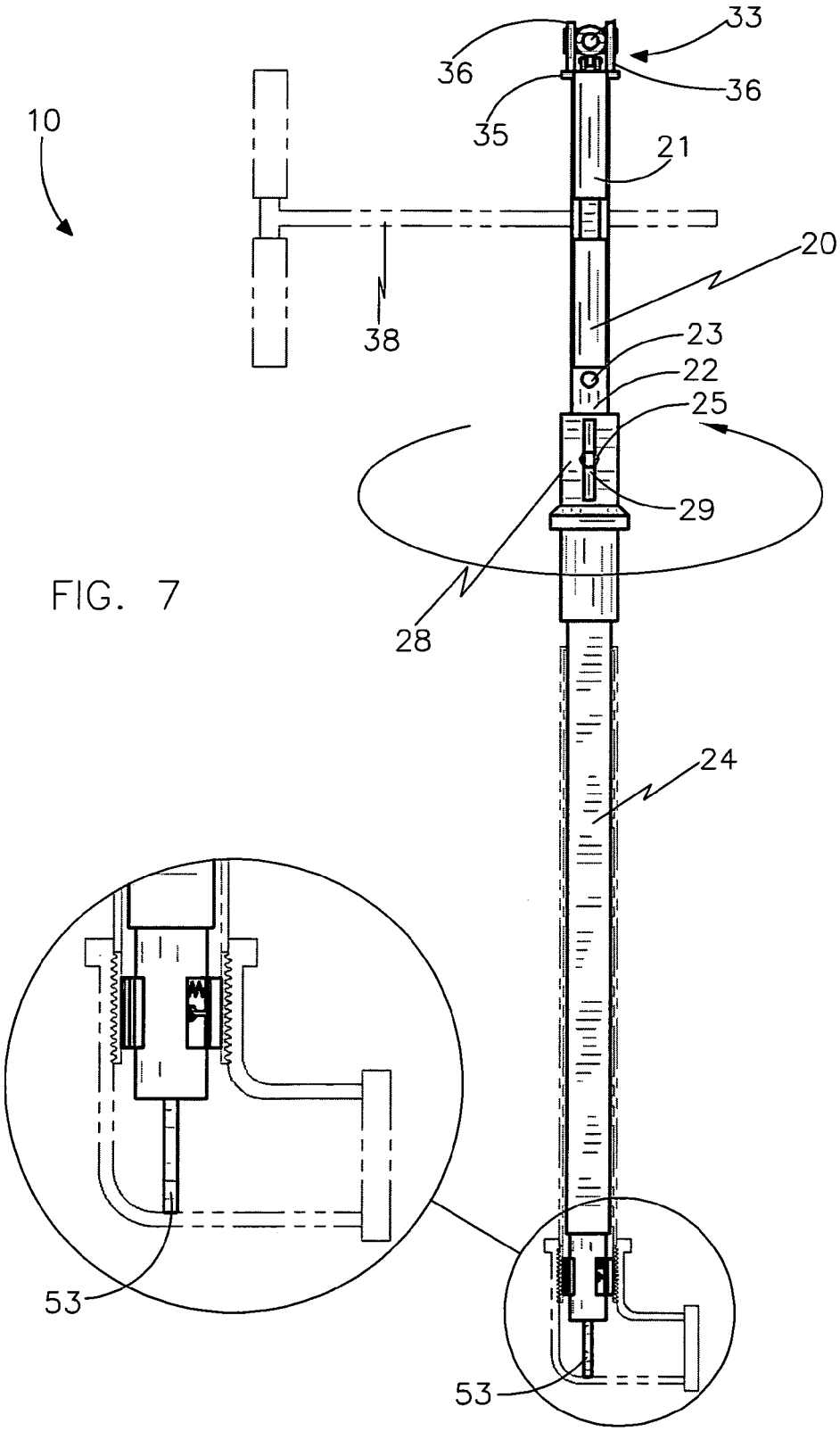
FIG. 7 is a rear elevational of a pneumatic pipe wrench, in operation with a pipe, in accordance with the present invention.
Figure 8:
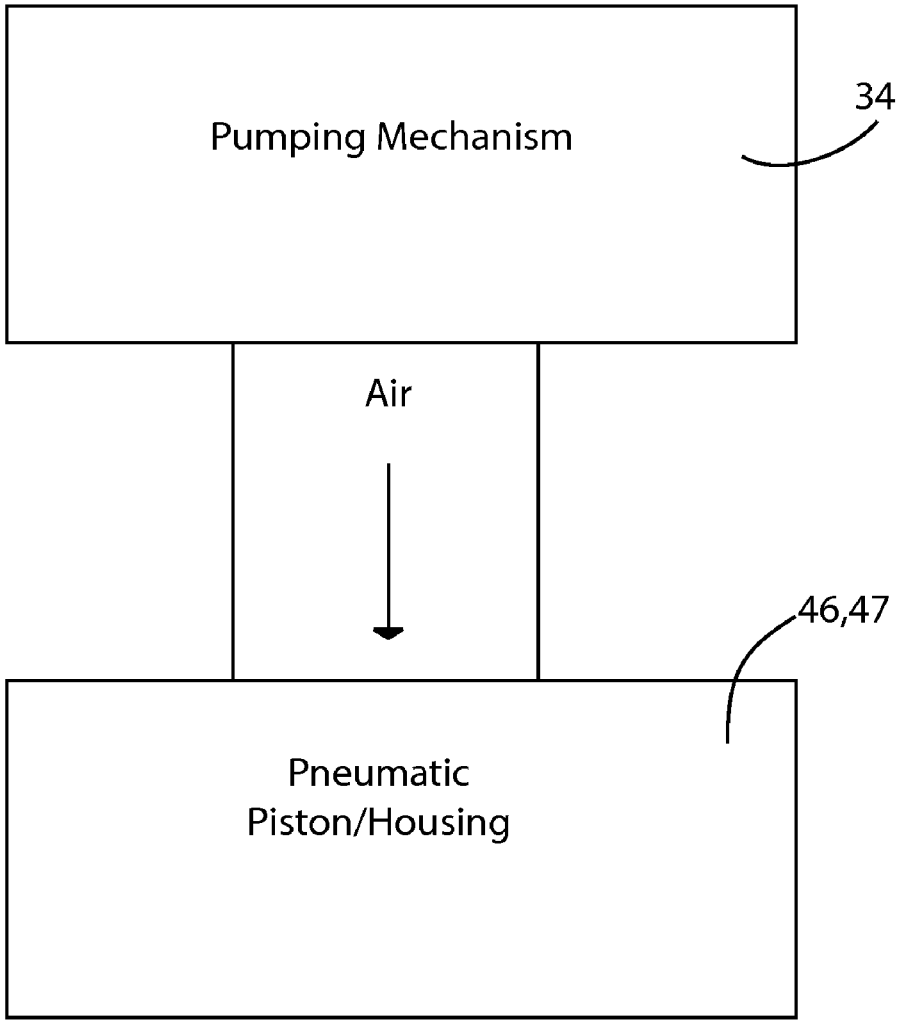
FIG. 8 is a schematic block diagram, showing the movement of air via the pumping mechanism, in accordance with the present invention.

Referring to FIGS. 6 and 7, the wrench further includes a mechanism for loosening the existing length of pipe. Such a loosening mechanism 54 is removably connected to the shaft. The loosening mechanism 54 includes the handle 38 of the pumping mechanism and the depressions 23 of the shaft 20. The distal end 40 of the handle is interfitted within an associated one of the depressions 23 of the shaft which is critical such that a force applied to the handle along the horizontal plane imparts a rotating force to the inner surface of the existing length of pipe via the bottom end of the shaft thereby loosening the existing length of pipe.

The removable adhering mechanism provides the unexpected benefit of allowing a user to secure the pneumatic pipe wrench within a pipe without ever digging or bending over. In addition, the loosening mechanism provides the unexpected benefit of loosening the pipe from the ground surface with ease. Such benefits overcome the prior art shortcomings.

In use, a method for assisting a user to remove an existing length of pipe from below a ground surface while the user remains above the ground surface includes the steps of providing an elongated shaft 20 with axially opposed top and bottom ends respectively. Such a shaft 20 has a hollow interior extending along an entire longitudinal length thereof. The shaft 20 has a uniform diameter extending along the longitudinal length thereof. The steps further include: connecting a cylindrical shaft guide 24 to the shaft 20; attaching the shaft guide 24 to the shaft 20; and securing the bottom end of the shaft 20 to an inner surface of the existing length of pipe. The removable securing mechanism 33 is directly attached, without the use of intervening characters, to the top and bottom ends of the shaft 20 respectively. The steps further include loosening the existing length of pipe. The loosening mechanism 54 is removably connected to the shaft.

In use, the method further includes the steps of providing an upper section with a pair of threaded apertures 25 formed therein. Such apertures 25 are located on diametrically opposed sides of the upper section of the shaft guide 24, and each of the apertures 25 has a centrally registered axis oriented perpendicular to a longitudinal length of the shaft guide 24. Each of the apertures 25 has a diameter that is equal to a diameter of each of the depressions 23 of the shaft 20. The steps further include providing a lower section 26 monolithically formed with the upper section 27 and extending downwardly therefrom. Such a lower section 26 has a longitudinal length equal to the upper section 27, and the lower section 26 further has a diameter that is equal to a diameter of the upper section 27. The steps further include interfitting the lower section 26 of the shaft guide 24 over a top end of the existing length of pipe during operating conditions wherein the respective diameters of the upper and lower sections 26, 27 are greater than a diameter of the shaft 20 such that the shaft 20 is telescopically interfitted within the shaft guide 24. The steps further include adjusting the shaft guide 24 telescopically along the entire longitudinal length of the shaft 20.

In use, the method of further includes the steps of penetrating a pair of threaded rods 29 with axially opposed proximal and distal ends 30, 31 respectively through an associated one of the apertures 25 of the shaft guide 24. Each of such rods 29 has a knob 32 directly attached, without the use of intervening characters, to the proximal end 30 thereof such that the knob 32 is spaced from the distal end 31 of the rod. The rod 29 rotates in sync with the knob 32. The steps further include abutting the distal end 31 of the rod 29 directly against an associated one of the depressions 23 of the shaft 20 when the rod 29 is penetrated through an associated one of the apertures 25 of the shaft guide 24. The rod 29 and the shaft guide 24 and the depressions 23 of the shaft 20 respectively cooperate to prohibit the shaft guide 24 from prematurely and undesirably shifting along the longitudinal length of the shaft during operating conditions.

In use, the method further includes the steps of providing a mechanism for pumping a quantity of air into the shaft. Such a pumping mechanism 34 includes providing a support plate 35 integrally attached to the top end of the shaft 20 and provided with opposed first and second ends respectively. Such a support plate 35 has a top surface oriented at a right angle to the longitudinal length of the shaft 20. The pumping mechanism further includes a pair of coextensively shaped anchor tabs 36 monolithically formed with the top surface of the support plate 35. Such tabs 36 extend upwardly and away from the top surface of the support plate 35, and the tabs 36 are located along laterally opposed edges of the support plate 35 and further are located at the first end of the support plate 35. Each of the tabs 36 has an inner surface oriented parallel to a longitudinal length of the support plate 35. The pumping mechanism 34 further includes the step of attaching a distal end of an arm 37 pivotally to each of the respective inner surfaces of the tabs 36.

In use, the steps further include biasing a proximal end of the arm 37 upwardly and away from the top surface of the support plate 35. The arm 37 is biased 180 degrees along an arcuate path defined by the pivot point, and the proximal end of the arm 37 has a cavity formed therein. The steps further include interfitting a distal end of a substantially T-shaped handle 38 with axially opposed proximal and distal ends respectively within the cavity of the arm. Such a distal end of the handle 38 has a diameter that is less than a diameter of the cavity of the arm, and such a proximal end of the handle 38 has a longitudinal length oriented perpendicular to the longitudinal length of the distal end of the handle 38. The steps further include manipulating the handle 38 such that a quantity of air is introduced into the shaft 20 during operating conditions thereby increasing a pressure of air contained within the shaft above a pressure of the ambient air outside of the shaft and providing a pressure-release valve 41 formed within the outer surface of the shaft 20 and located subjacent to the top end of the shaft. Such a valve 41 is for releasing an air pressure contained within the shaft.

In use, the steps further include providing a mechanism for removably adhering the bottom end of the shaft to an inner surface of the existing length of pipe. Such a removable adhering mechanism 42 includes providing a first toothed surface 43 monolithically formed in a portion of the outer surface of the bottom end of the shaft 20, and connecting a curvilinear arm 44 with a first end pivotally to the outer surface of the bottom end of the shaft. Such an arm 44 is located on a diametrically opposed side from the first toothed surface 43, and has a second toothed surface 45 formed in an outer surface thereof. The steps further include biasing the arm 44 outwardly and away from the shaft 20 along a first arcuate path such that the second toothed 45 surface abuts directly against, without the use of intervening characters, the inner surface of the existing length of pipe and is statically adhered thereto during operating conditions and providing a housing 46 integrally attached to the inner surface of the bottom end of the shaft 20. Such a housing 46 is in fluid communication with the pumping mechanism such that a quantity of air introduced into the shaft 20 via the pumping mechanism is channeled through the housing.

In use, the steps further include providing a linear piston 47 with a first end telescopically interfitted within the housing 46. Such a piston 47 has a second end 49 extending outwardly and away from the first end 48 of the piston, and the second end of the piston 47 contacts an inner surface of the arm 44. The steps further include introducing an air pressure into the housing 46 via the shaft 20 and the pumping mechanism respectively such that the air pressure shifts the piston 47 along a first linear path such that the piston causes the arm 44 to bias away from the shaft 20 along the first arcuate path and further causes the second toothed 45 surface of the arm 44 to statically abut against the inner surface of the existing length of pipe. The steps further include providing a spring member 50 with a first end 51 statically affixed to the inner surface of the shaft 20. Such a spring member 50 has a second end 52 pivotally attached to a second end of the arm 44. The spring member 50 returns the arm 44 to an equilibrium position along a second arcuate path defined opposite of the first arcuate path when the pressure release valve is manipulated thereby reducing the air pressure within the shaft and the housing respectively. The reduced air pressure allows the spring member to return the arm to equilibrium and simultaneously causes the piston to return to equilibrium along a second linear path defined opposite of the first linear path.

In use, the steps further include providing a linear pin 53 statically attached to a center region of the bottom end of the shaft 20 and extending downwardly and away therefrom. Such a pin 53 has a longitudinal length registered parallel with the longitudinal length of the shaft. The pin 53 is for spacing the bottom end of the shaft 20 from an inner surface of another existing length of pipe connected at a right angle to the existing length of pipe.

In use, the method further includes the steps of: providing the handle 38 of the pumping mechanism; providing the depressions 23 of the shaft; interfitting the distal end of the handle 38 is within an associated one of the depressions 23; applying a force to the handle 38 along the horizontal plane thereby imparting a rotating force to the inner surface of the existing length of pipe via the bottom end of the shaft 20; loosening the existing length of pipe; removing the existing length of pipe from below the ground surface; manipulating the valve 41 and returning the air pressure within the shaft 20 to equilibrium; and removing the shaft 20 from the existing length of pipe. Alternatively, the user may also employ a traditional pipe wrench to the outer surface of the shaft and thereby loosen the shaft.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A pneumatic pipe wrench for assisting a user to remove an existing length of pipe from below a ground surface while the user remains above the ground surface, said pneumatic pipe wrench comprising:

an elongated shaft provided with axially opposed top and bottom ends respectively, said shaft having a hollow interior extending along an entire longitudinal length thereof;

a cylindrical shaft guide removably connected to said shaft;

means for attaching said shaft guide to said shaft;

means for removably securing said bottom end of said shaft to an inner surface of the existing length of pipe, said removably securing means being directly attached to said top and bottom ends of said shaft respectively; and means for loosening said existing length of pipe, said loosening means being removably connected to said shaft.

2. The pneumatic pipe wrench of claim 1, wherein said shaft has a plurality of circular holes monolithically formed in an outer surface thereof, said holes being diametrically opposed about said shaft and further being equidistantly spaced along said longitudinal length of said shaft, each of said holes terminating proximal to an inner surface of said shaft.

3. The pneumatic pipe wrench of claim 2, wherein said shaft guide comprises:

an upper section having a pair of threaded apertures formed therein, said apertures being located on diametrically opposed sides of said upper section of said shaft guide, each of said apertures having a centrally registered axis oriented perpendicular to a longitudinal length of said shaft guide, each of said apertures having a diameter that is equal to a diameter of each of said holes of said shaft; and a lower section monolithically formed with said upper section and extending downwardly therefrom, said lower section having a longitudinal length equal to said upper section, said lower section of said shaft guide being interfitted over a top end of the existing length of pipe during operating conditions;

wherein said respective diameters of said upper and lower sections are greater than a diameter of said shaft such that said shaft is telescopically interfitted within said shaft guide, said shaft guide being telescopically adjusted along said entire longitudinal length of said shaft.

4. The pneumatic pipe wrench of claim 3, wherein said attaching means comprises:

a pair of threaded rods having axially opposed proximal and distal ends respectively, said distal end of said rod removably penetrating an associated one of said apertures of said shaft guide, each of said rods having a knob directly attached to said proximal end thereof such that said knob is spaced from said distal end of said rod, said rod rotating in sync with said knob;

wherein said distal end of said rod directly abuts an associated one of said holes of said shaft when said rod is penetrated through an associated one of said apertures of said shaft guide, said rods and said shaft guide and said holes of said shaft respectively cooperating to prohibit said shaft guide from prematurely and undesirably shifting along said longitudinal length of said shaft during operating conditions.

5. The pneumatic pipe wrench of claim 4, wherein said removably securing means comprises:

a pumping mechanism for propelling a quantity of air into said shaft, said pumping mechanism comprising a support plate integrally attached to said top end of said shaft and provided with opposed first and second ends respectively, said support plate having a top surface oriented at a right angle to said longitudinal length of said shaft, a pair of coextensively shaped anchor tabs monolithically formed with said top surface of said support plate, said tabs extending upwardly and away from said top surface of said support plate, said tabs being located along laterally opposed edges of said support plate and further being located at said first end of said support plate, each of said tabs having an inner surface oriented parallel to a longitudinal length of said support plate, an arm provided with a distal end pivotally attached to each of said respective inner surfaces of said tabs, said arm having a proximal end extending upwardly and away from said top surface of said support plate, said arm being movable along an arcuate path defined by said pivot point, said proximal end of said arm having a cavity formed therein, a substantially T-shaped handle having axially opposed proximal and distal ends respectively, said distal end of said handle having a diameter that is less than a diameter of said cavity of said proximal end of said arm such that said distal end of said handle is removably interfitted with said cavity of said arm during operating procedures, said proximal end of said handle having a longitudinal length oriented perpendicular to said longitudinal length of said distal end of said handle, said handle being manipulated by the user such that a quantity of air is introduced into said shaft during operating conditions and thereby increasing a pressure level of air contained within said shaft above a pressure level of the ambient air outside of said shaft, and a pressure-release valve formed within said outer surface of said shaft and located subjacent to said top end of said shaft, said valve for releasing the air pressure level contained within said shaft; and a mechanism for removably adhering said bottom end of said shaft to an inner surface of the existing length of pipe, said mechanism for removably adhering comprising a first toothed surface monolithically formed in a portion of said outer surface of said bottom end of said shaft, a curvilinear arm having a first end pivotally connected to said outer surface of said bottom end of said shaft, said arm being located on a diametrically opposed side from said first toothed surface, said arm having a second toothed surface formed in an outer surface thereof, said arm extending outwardly and away from said shaft along a first arcuate path such that said second toothed surface abuts directly against the inner surface of the existing length of pipe and is statically adhered thereto during operating conditions, a housing integrally attached to said inner surface of said bottom end of said shaft, said housing being in fluid communication with said pumping mechanism such that a quantity of air introduced into said shaft via said pumping mechanism is channeled through said housing, a linear piston having a first end telescopically interfitted within said housing, said piston having a second end extending outwardly and away from said first end of said piston, said second end of said piston contacting an inner surface of said arm, wherein an air pressure introduced into said housing via said shaft and said pumping mechanism respectively shifts said piston along a first linear path such that said piston causes said arm to extend away from said shaft along said first arcuate path and further causes said second toothed surface of said arm to statically abut against the inner surface of the existing length of pipe, a spring member having a first end statically affixed to said inner surface of said shaft, said spring member having a second end pivotally attached to a second end of said arm, and a linear pin statically attached to a center region of said bottom end of said shaft and extending downwardly and away therefrom, said pin having a longitudinal length registered parallel with said longitudinal length of said shaft, said pin for spacing said bottom end of said shaft from an inner surface of another existing length of pipe connected at a right angle to the existing length of pipe;

wherein said spring member returns said arm to an equilibrium position along a second arcuate path defined opposite to said first arcuate path when said pressure release valve is manipulated and thereby reducing the air pressure level within said shaft and said housing respectively, the reduced air pressure level allowing said spring member to return said arm to equilibrium and simultaneously cause said piston to return to equilibrium along a second linear path defined opposite of said first linear path.

6. The pneumatic pipe wrench of claim 5, wherein said loosening means comprises:

said handle of said pumping mechanism; and said holes of said shaft;

wherein said distal end of said handle is interfitted within an associated one of said holes of said shaft such that a force applied to said handle along the horizontal plane imparts a rotating force to said inner surface of said existing length of pipe via said bottom end of said shaft and thereby loosening said existing length of pipe.

7. A pneumatic pipe wrench for assisting a user to remove an existing length of pipe from below a ground surface while the user remains above the ground surface, said pneumatic pipe wrench comprising:

an elongated shaft provided with axially opposed top and bottom ends respectively, said shaft having a hollow interior extending along an entire longitudinal length thereof, said shaft having a uniform diameter extending along said longitudinal length thereof;

a cylindrical shaft guide removably connected to said shaft;

means for attaching said shaft guide to said shaft;

means for removably securing said bottom end of said shaft to an inner surface of the existing length of pipe, said removably securing means being directly attached to said top and bottom ends of said shaft respectively; and means for loosening said existing length of pipe, said loosening means being removably connected to said shaft.

8. The pneumatic pipe wrench of claim 7, wherein said shaft has a plurality of circular holes monolithically formed in an outer surface thereof, said holes being diametrically opposed about said shaft and further being equidistantly spaced along said longitudinal length of said shaft, each of said holes terminating proximal to an inner surface of said shaft.

9. The pneumatic pipe wrench of claim 8, wherein said shaft guide comprises:

an upper section having a pair of threaded apertures formed therein, said apertures being located on diametrically opposed sides of said upper section of said shaft guide, each of said apertures having a centrally registered axis oriented perpendicular to a longitudinal length of said shaft guide, each of said apertures having a diameter that is equal to a diameter of each of said holes of said shaft; and a lower section monolithically formed with said upper section and extending downwardly therefrom, said lower section having a longitudinal length equal to said upper section, said lower section of said shaft guide being interfitted over a top end of the existing length of pipe during operating conditions;

wherein said respective diameters of said upper and lower sections are greater than a diameter of said shaft such that said shaft is telescopically interfitted within said shaft guide, said shaft guide being telescopically adjusted along said entire longitudinal length of said shaft.

10. The pneumatic pipe wrench of claim 9, wherein said attaching means comprises:

a pair of threaded rods having axially opposed proximal and distal ends respectively, said distal end of said rod removably penetrating an associated one of said apertures of said shaft guide, each of said rods having a knob directly attached to said proximal end thereof such that said knob is spaced from said distal end of said rod, said rod rotating in sync with said knob;

wherein said distal end of said rod directly abuts an associated one of said holes of said shaft when said rod is penetrated through an associated one of said apertures of said shaft guide, said rods and said shaft guide and said holes of said shaft respectively cooperating to prohibit said shaft guide from prematurely and undesirably shifting along said longitudinal length of said shaft during operating conditions.

11. The pneumatic pipe wrench of claim 10, wherein said removably securing means comprises:

a pumping mechanism for propelling a quantity of air into said shaft, said pumping mechanism comprising a support plate integrally attached to said top end of said shaft and provided with opposed first and second ends respectively, said support plate having a top surface oriented at a right angle to said longitudinal length of said shaft, a pair of coextensively shaped anchor tabs monolithically formed with said top surface of said support plate, said tabs extending upwardly and away from said top surface of said support plate, said tabs being located along laterally opposed edges of said support plate and further being located at said first end of said support plate, each of said tabs having an inner surface oriented parallel to a longitudinal length of said support plate, an arm provided with a distal end pivotally attached to each of said respective inner surfaces of said tabs, said arm having a proximal end extending upwardly and away from said top surface of said support plate, said arm being movable along an arcuate path defined by said pivot point, said proximal end of said arm having a cavity formed therein, a substantially T-shaped handle having axially opposed proximal and distal ends respectively, said distal end of said handle having a diameter that is less than a diameter of said cavity of said proximal end of said arm such that said distal end of said handle is removably interfitted with said cavity of said arm during operating procedures, said proximal end of said handle having a longitudinal length oriented perpendicular to said longitudinal length of said distal end of said handle, said handle being manipulated by the user such that a quantity of air is introduced into said shaft during operating conditions thereby increasing a pressure level of air contained within said shaft above a pressure level of the ambient air outside of said shaft, and a pressure-release valve formed within said outer surface of said shaft and located subjacent to said top end of said shaft, said valve for releasing the air pressure level contained within said shaft; and a mechanism for removably adhering said bottom end of said shaft to an inner surface of the existing length of pipe, said mechanism for removably adhering comprising a first toothed surface monolithically formed in a portion of said outer surface of said bottom end of said shaft, a curvilinear arm having a first end pivotally connected to said outer surface of said bottom end of said shaft, said arm being located on a diametrically opposed side from said first toothed surface, said arm having a second toothed surface formed in an outer surface thereof, said arm extending outwardly and away from said shaft along a first arcuate path such that said second toothed surface abuts directly against the inner surface of the existing length of pipe and is statically adhered thereto during operating conditions, a housing integrally attached to said inner surface of said bottom end of said shaft, said housing being in fluid communication with said pumping mechanism such that a quantity of air introduced into said shaft via said pumping mechanism is channeled through said housing, a linear piston having a first end telescopically interfitted within said housing, said piston having a second end extending outwardly and away from said first end of said piston, said second end of said piston contacting an inner surface of said arm, wherein an air pressure introduced into said housing via said shaft and said pumping mechanism respectively shifts said piston along a first linear path such that said piston causes said arm to extend away from said shaft along said first arcuate path and further causes said second toothed surface of said arm to statically abut against the inner surface of the existing length of pipe, a spring member having a first end statically affixed to said inner surface of said shaft, said spring member having a second end pivotally attached to a second end of said arm, and a linear pin statically attached to a center region of said bottom end of said shaft and extending downwardly and away therefrom, said pin having a longitudinal length registered parallel with said longitudinal length of said shaft, said pin for spacing said bottom end of said shaft from an inner surface of another existing length of pipe connected at a right angle to the existing length of pipe;

wherein said spring member returns said arm to an equilibrium position along a second arcuate path defined opposite to said first arcuate path when said pressure release valve is manipulated thereby reducing the air pressure level within said shaft and said housing respectively, the reduced air pressure level allowing said spring member to return said arm to equilibrium and simultaneously cause said piston to return to equilibrium along a second linear path defined opposite of said first linear path.

12. The pneumatic pipe wrench of claim 11, wherein said loosening means comprises:

said handle of said pumping mechanism; and said holes of said shaft;

wherein said distal end of said handle is interfitted within an associated one of said holes of said shaft such that a force applied to said handle along the horizontal plane imparts a rotating force to said inner surface of said existing length of pipe via said bottom end of said shaft and thereby loosening said existing length of pipe.

* * * * *